United States Patent [19]

Thomas, II

[11] Patent Number: 5,031,868

[45] Date of Patent: Jul. 16, 1991

[54] RACK MOUNTED MUSICAL INSTRUMENT STAND

[76] Inventor: Richard G. Thomas, II, 219 West Milling, Lancaster, Calif. 93534

[21] Appl. No.: 495,869

[22] Filed: Mar. 19, 1990

[51] Int. Cl.[5] ..... G10G 5/00

[52] U.S. Cl. ..... 248/283; 84/327

[58] Field of Search ..... 248/283, 443, 121; 84/327, 453

[56] References Cited

U.S. PATENT DOCUMENTS 3,348,799 10/1967 Junkel ..... 248/283
3,765,633 10/1973 Caudill ..... 84/327
3,958,786 5/1976 Mann ..... 84/327
4,691,610 9/1987 Gilbert ..... 84/327

*Primary Examiner*—Robert L. Wolfe
*Attorney, Agent, or Firm*—Nilsson, Robbins, Dalgarn, Berliner, Carson & Wurst

[57] ABSTRACT

A support apparatus for musical instruments, including a mounting frame, a guide assembly, a support assembly and an instrument retention assembly, the support assembly being coupled to the instrument retention assembly and retractable into the mounting frame, which may be mounted within a component slot of a component mounting rack.

12 Claims, 3 Drawing Sheets

FIG. 1
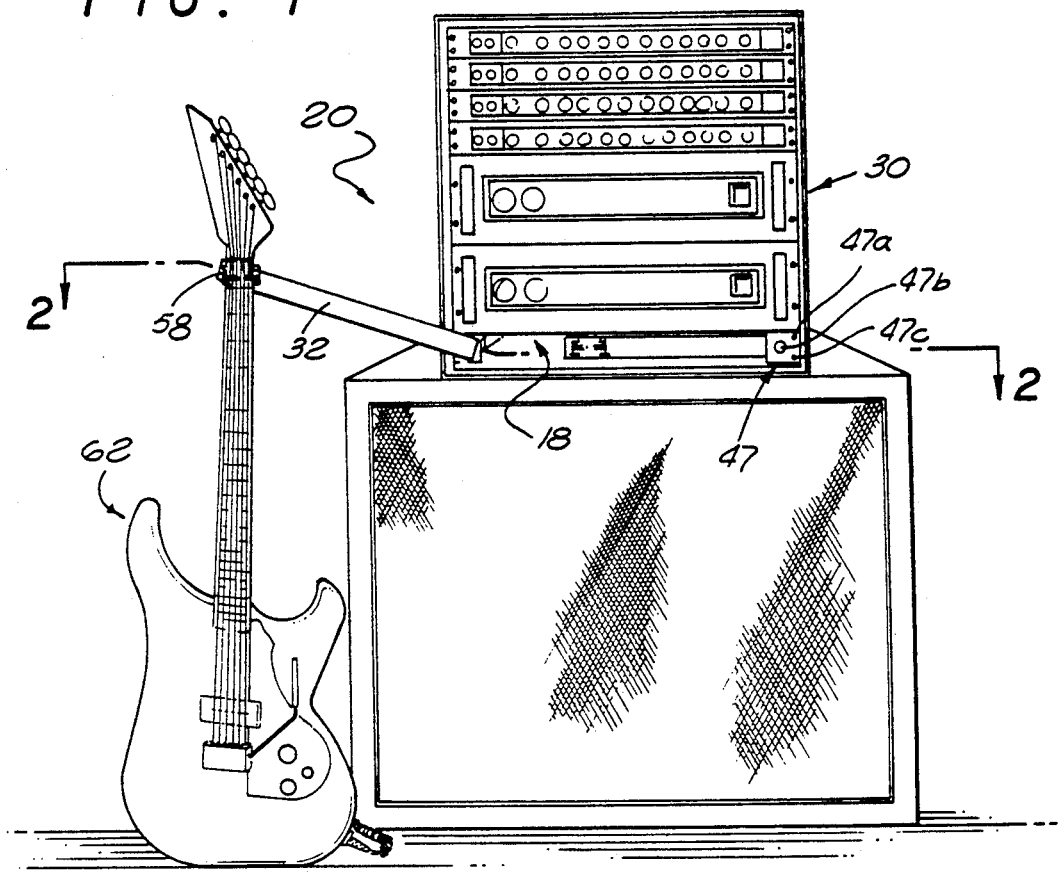
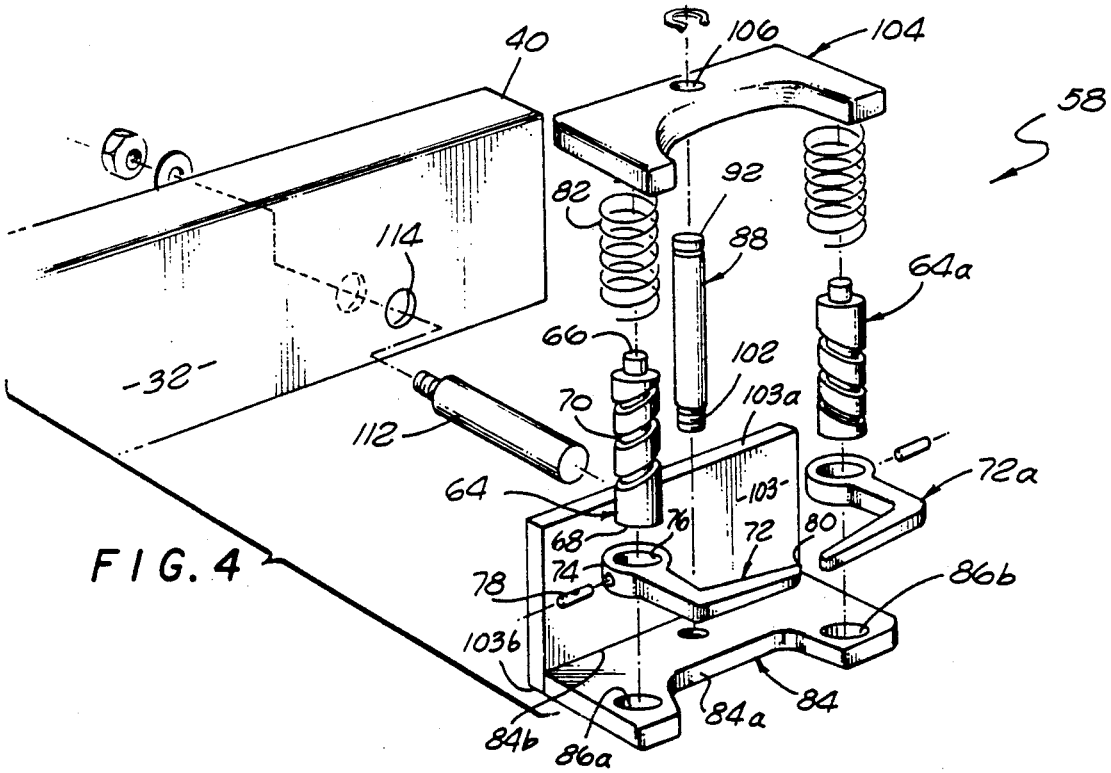
FIG. 4

RACK MOUNTED MUSICAL INSTRUMENT STAND

BACKGROUND OF THE INVENTION

The present invention relates to a support for an object, and more particularly to a support apparatus for musical instruments, the apparatus mounted in a slot of an electronic component mounting rack.

Professional musicians use component mounting racks, in which various electronic musical devices, such as amplifiers, pre-amplifiers, equalizers, mixers, and the like, are mounted. The racks have recesses or "slots", one atop another, into which the electronic devices are inserted. Manufactures of such electronic devices often conform the exterior dimensions of their products to the dimensions of the slots of the component mounting racks.

Professional musicians also utilize musical instrument supports or "stands", which are placed on the stage to hold one instrument while another is in use. Previous devices for supporting musical instruments have been free standing mechanisms, unconnected with a component mounting rack. Such devices for guitars have typically provided an upper member against which the neck of a guitar rests, and a lower member on which the body of the guitar rests. However, these free-standing instrument supports lack any restraints which would prevent the instrument from toppling on impact. Further, the stands themselves often rest on relatively small bases, and are therefore unstable and susceptible to being knocked over by a slight impact. Typically there is a great deal of movement during a musical performance, particularly if the music is of the "rock" variety. Thus, guitars and other instruments are at risk of being toppled. Such mishaps can be quite costly, if an expensive professional instrument is damaged.

Additionally, since previous musical instrument stands were free-standing devices, a great deal of effort and money had to be expended in repeatedly moving them. Movers or road managers had to pack them at one location, move them to the site of a concert, set them up at the concert location, and then separately re-pack them for transport to the location of the next concert.

The present invention is a musical instrument stand adapted to be mounted into a component mounting rack, which may be folded completely into the rack for ease of moving. The stand includes a self-locking object retention means, which prevents the instrument from falling if impacted.

SUMMARY OF THE INVENTION

A rack mountable assembly for supporting musical instruments. The assembly comprises one or more arms coupled to a mounting bracket, which in turn is inserted into a component slot of a component mounting rack. Each arm moves forwardly out of a storage position in the rack, and pivots into an unstored position for receiving the instrument. The arm includes at least one object retention means. In a preferred embodiment, the object retention means encloses three sides of a musical instrument and has one or more instrument restraints coupled to an instrument jaw such that when the jaw is urged downward by the weight of the instrument, the instrument restraint pivots, blocking the fourth side of the instrument, and thereby preventing any egress.

BRIEF DESCRIPTION OF THE DRAWINGS

The invention will be better understood from the following detailed description thereof taking in conjunction with the accompanying drawings, in which:

FIG. 1 is a front elevational view of the present invention utilized in a component mounting rack, in which an arm of the present invention is extended for receiving a musical instrument;

FIG. 4 is an expanded view of one of the object retention means of the present invention;

DETAILED DESCRIPTION

Figures 2, 3:
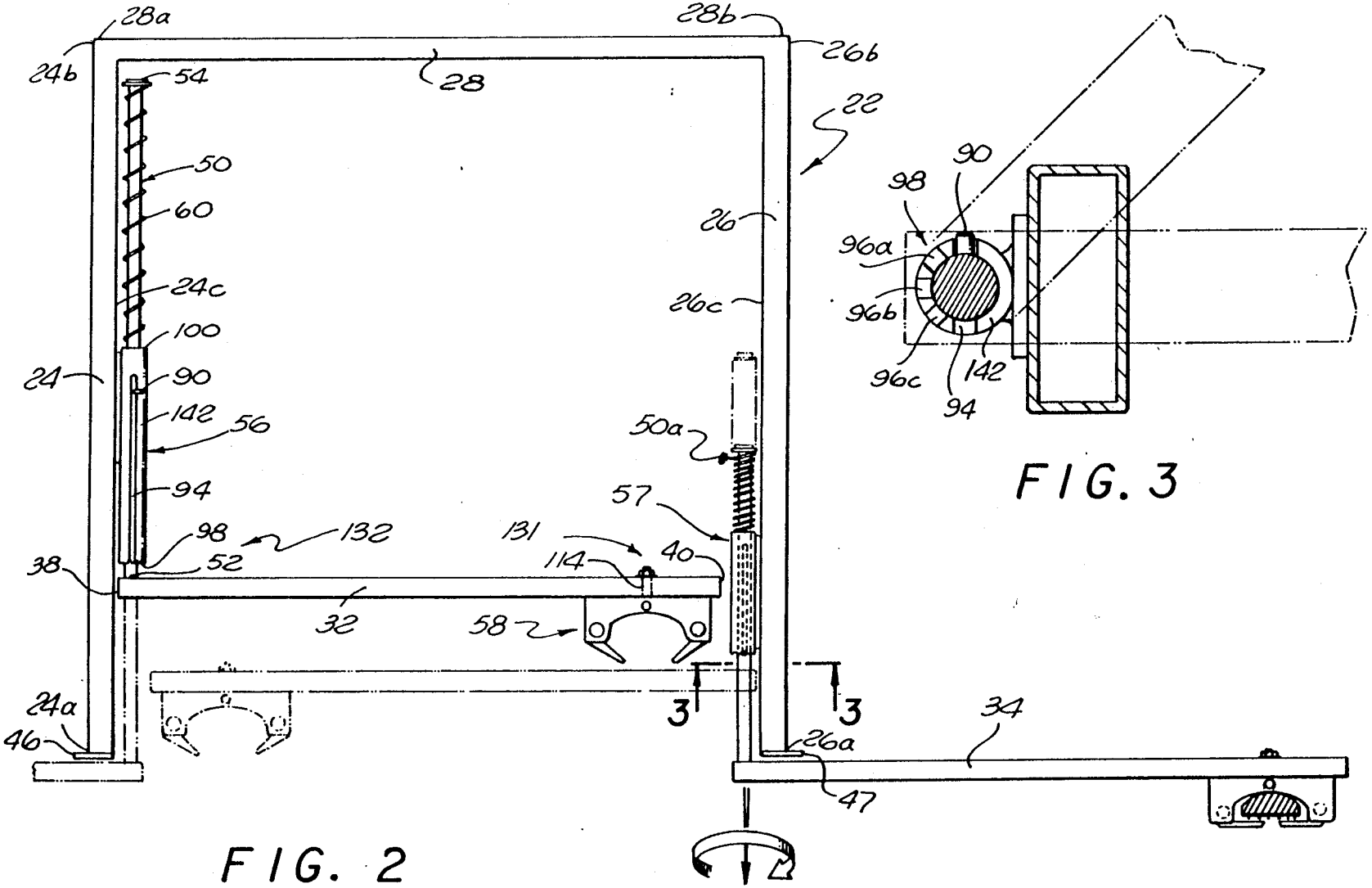
FIG. 2 is a top plan view of the present invention.
FIG. 3 is a front elevational view of the guide means of the present invention, showing a support arm in relief.

Referring to FIG. 1 in conjunction with FIG. 2, an apparatus for supporting musical instruments 20 includes a mounting frame 22 having a first member 24 with a front end 24*a*, a rear end 24*b* and an interior face 24*c*; a second member 26 with a front end 26*a*, a rear end 26*b* and an interior face 26*c*; and a rear member 28, with a first end 28*a* and a second end 28*b*. The first end 28*a* of the rear member 28 is coupled to the second end 24*b* of the first member 24, and the second end 28*b* of the rear member 28 is coupled to the rear end 26*b* of the second member 26. In a preferred embodiment, the first member 24, second member 26 and rear member 28 form three sides of a rectangle, which partially encloses a storage area 120. The interior face 24*c* of the first member 24 and the interior face 26*c* of the second member 26 face inward toward the storage area 120.

A first mounting bracket 46 is affixed to the first end 24*a* of the first member 24 and a second mounting bracket 47 is affixed to the first end 26*a* of the second member 26. The second mounting bracket 47 defines one or more apertures, such as 47*a*, 47*b* and 47*c*, for holding the apparatus 20 to a component slot 18 of a component mounting rack 30. The first mounting bracket 46 defines similar apertures (not shown).

Referring to FIG. 2 and FIG. 3, a first guide means 56, having a first end 98 and a second end 100, is mounted to the interior face 24*c* of the first member 24 of the mounting frame 22. The first end 98 is distant from the rear member 28, and the second end 100 is near the rear member 28. A second guide means 57 is mounted to the interior face 26*c* of the second member 26. Since the first and second guide means 56 and 57 are mirror images of each other, only the first guide means 56 will be described in detail. The first guide means 56 defines a sleeve 142 with a guide channel 94, at least part way along its length, beginning at the first end 98 of the guide means 56. The first end 98 defines one or more recesses, such as recesses 96*a*, 96*b* and 96*c*.

The present invention 20 also provides a first support means 132, as shown in FIG. 2. In a preferred embodiment, a second support means 131 is also provided. Additional support means can be included. The two support means 131 and 132 are mirror images of each other, and consequently only the first support means 132 will be described in detail. The first support means 132 includes a first support arm 32, which has a first end 38 and a second end 40. The second end 40 defines an aperture 114 for mounting of an object retention means 58.

The first support means 132 also includes a first support shaft 50 having a first end 52 and a flared second end 54. The first end 52 is mounted to the first end 38 of the first support arm 32, in generally perpendicular relationship to the support arm 32. The first support shaft 50 is slidingly interconnected to the sleeve 142 of the first guide means 56, with the flared second end 54 adjacent to the rear member 28. A spring 60 is positioned between the flared second end 54 and the second end 100 of the first guide means 56 for urging the first support shaft 50 into a fully retracted storage position with the flared second end 54 adjacent to the rear member 28. A limit pin 90 is mounted to the first support shaft 50 to engage the guide channel 94 to maintain a horizontal alignment of the arm 32 as it is moved into the storage position in the storage area 120. The limit pin 90 is also positioned to engage the recesses 96*a*, 96*b*, 96*c* in the first end 98 of the first guide means 56, to prevent rotational movement of the first support shaft 50 when it is extended away from the rear member 28, and then to fix the first support shaft 50 in a selected angular orientation when in a fully extended position. In a preferred embodiment, a second support means 131 has a second support shaft 50*a* for coupling with the second support arm 34.

The first support arm 32 is in a stored position when the flared second end 54 of the first support shaft 50 is adjacent to the rear member 28, and the first support arm 32 is positioned between the first member 24 and the second member 26. When a user wishes to support a musical instrument 62, he or she pulls the first support arm 32 away from the rear member 28. This causes the first support shaft 50 to laterally move outwardly through the guide means 56. The limit pin 90 thus travels along the guide channel 94, which allows translational movement of the first support shaft 50 and the first support arm 32, but not rotational movement. When the limit pin 90 reaches the first end 98 of the guide means 56, the guide channel 94 no longer restrains rotational movement, and the user may rotate the first support arm 32 so that the first support arm 32 extends outwardly from the component rack 30 to receive an instrument.

The user may further rotate the first support arm 32 into a desired angle, and secure it at that angle by allowing the limit pin 90 to engage the nearest of the recess 96*a*, 96*b*, or 96*c*. For example, if there is no shortage of space, the user may wish to rotate the first support arm 32 one-hundred and eighty degrees, causing the first support arm 32 to extend horizontally away from the component mounting rack 30. If space is limited, the user may wish to rotate the support arm less than one-hundred and eighty degrees, causing the first support arm 32 to extend somewhat upwards or downwards from the component mounting rack 30 (as shown in FIG. 1), requiring less space.

The second support means 131, including the second support arm 34, the second support shaft 50*a* and the second guide means 57, and their coupling with the mounting frame 22, represent a mirror image of the first support means 132. In a preferred embodiment, the second support means 131 and the second guide means 57 are mounted distant from the rear member 28 such that the second support arm 34 must be extended before the first support arm 32 may be extended. In turn, the first support arm 32 must be reinserted into the component slot 18 before the second support arm 34 can be inserted, when both are to be positioned in the stored position.

When the user wishes to transport the component mounting rack 30, or is not using the apparatus 20, he or she will pull outward on the first support arm 32 to disengage the limit pin 90 from one of the recesses 96*a*, 96*b*, or 96*c*, and rotate it until the limit pin 90 engages the guide channel 94 of the guide means 56, and insert the first support arm 32 into the component slot 18. The spring 60 will retain the first support arm 32 in the stored position within the component slot 18. The same procedure will be repeated with the second support arm 34, and the component mounting rack 30 will be ready for storage or transportation.

The present invention 20 may also include an object retention means 58, shown in detail in FIG. 4. The object retention means 58 has a shaft 88, an upper instrument jaw 104, a lower instrument jaw 84, having a front side 84*a* and a rear side 84*b*, and a side member 103 having an upper end 103*a* and a lower end 103*b*. The lower end 103*b* is coupled, in generally perpendicular relationship, to the rear side 84*b* of the lower instrument jaw 84. A pin 112 is affixed, in generally perpendicular relationship, to the side member 103 adjacent to the upper end 103*a*. The pin 112 is rotationally mounted to the aperture 114 in the first support arm 32 adjacent to the second end 40. In a preferred embodiment, additional support arms and object retention means are provided, and are coupled in a similar manner.

The upper instrument jaw 104 defines an aperture 106, and the lower instrument jaw 84 defines a plurality of apertures, such as 86*a* and 86*b*. The lower instrument jaw 84 is heavier than the upper instrument jaw 104. The shaft 88 has two ends, a flared first end 92 and a second end 102, the flared first end 92 passing through aperture 106 in the upper instrument jaw 104 such that the upper instrument jaw 104 can move up and down the shaft 88, but not beyond the limit of the flared first end 92. The second end 102 is fixedly mounted to the lower instrument jaw 84 in any suitable manner.

In the preferred embodiment, a first grooved shaft 64 and a second grooved shaft 64*a* are provided, for coupling with the upper instrument jaw 104 and the lower instrument jaw 84. The two grooved shafts 64 and 64*a* are mirror images of each other, and only the first grooved shaft 64 need be described in detail. The first grooved shaft 64 has a spiral surface groove 70, a first end 66 and a second end 68. The first end 66 is rigidly mounted to the upper instrument jaw 104, and the second end 68 slidingly passes through one of the apertures, such as 86*a*, in the lower instrument jaw 84. An instrument restraint 72 is also provided. In a preferred embodiment, the instrument restraint 72 is arcular. The instrument restraint 72 has a first end 74 and a second end 80, the first end 74 defining an aperture 76. A pin 78 extends radially through the first end 74 of the restraint 72 into the aperture 76. The first grooved shaft 64 passes through the aperture 76, and the pin 78 engages the surface groove 70. The instrument restraint 72 is located between the upper instrument jaw 104 and the lower instrument jaw 84. A spring 82 is provided for the first grooved shaft 64, which surrounds the first grooved shaft 64 and is located above the instrument restraint 72 and below the upper instrument jaw 104.

Figure 5:
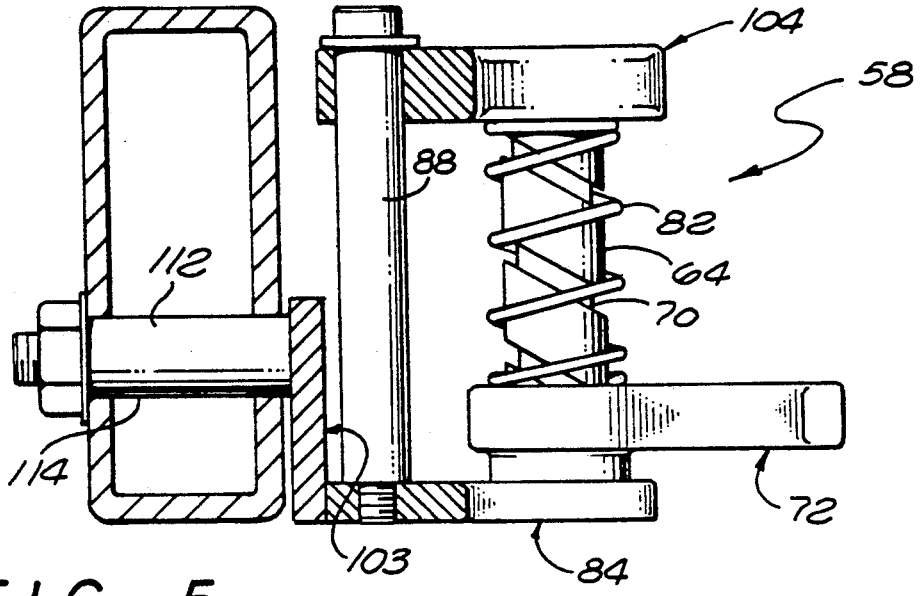
FIG. 5 is a side elevational view of one of the object retention means of the present invention, showing the instrument restraint in its open position.

When a user moves the first support arm 32 into one of the extended positions by securing the limit pin 90 within one of the recesses, 96*a*, 96*b*, or 96*c*, in the guide means 56, the object retention means 58 automatically rotates about the pin 112 to the proper position for receiving a musical instrument 62, due to the heavier weight of the lower instrument jaw 84. FIG. 5 shows the instrument restraint 72 in an open position, ready to receive the instrument 62.

Figure 6:
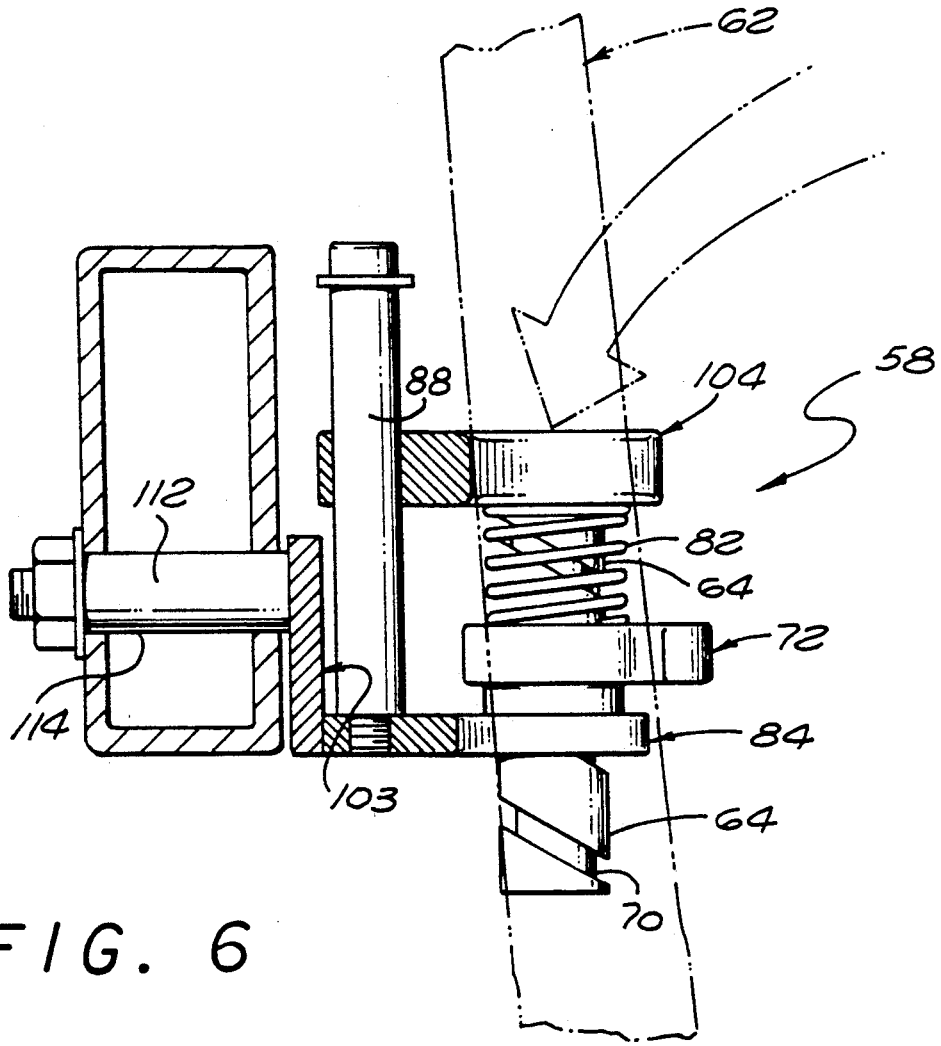
FIG. 6 is a side elevational view of one of the object retention means of the present invention, showing the instrument restraint in its closed position.

The user places the musical instrument 62 in the object retention means 58, with the wider portion of the neck of the instrument 62 resting on the top of the upper instrument jaw 104. The weight of the instrument 62 will urge the upper instrument jaw 104 downward, causing the first grooved shaft 64 to likewise move downward through an aperture such as 86*a*. The surface groove 70 engages the pin 78 of the instrument restraint 72 and causes the instrument restraint 72 to rotate into a position in which it is blocking any egress of the instrument 62. FIG. 6, shows the instrument restraint 72 in its blocking position. In a preferred embodiment, a second grooved shaft 64*a* is provided, and downward movement of the upper instrument jaw 104 will also cause the second grooved shaft 64*a* to move downward through an aperture, such as 86*b*, causing a second instrument restraint 72*a* to rotate in a manner similar to that of the first instrument restraint 72. In the event of impact, the instrument 62 will not be subject to lateral movement, so long as the component mounting rack 30 remains upright. Component mounting racks 30 are typically quite heavy, and rest on a relatively large surface area, so they do not generally topple.

To remove the instrument 62, the user will lift it upwards, allowing the spring 82 to urge the upper instrument jaw 104 and the first grooved shaft 64 upwards, causing the surface groove 70 to urge the pin 78 and instrument restraint 72 to rotate back into their open position. If provided, the second instrument restraint 72*a* will open in a similar manner.

This represents one possible embodiment of the present invention. Those skilled in the art may devise other embodiments without departing from the spirit and scope of the invention.

What is claimed is:

1. An apparatus for supporting an object such as a musical instrument, the apparatus being retractable into a component slot of an electronic component mounting rack, the apparatus comprising:

a mounting frame for insertion into the component slot of the component mounting rack;

at least one support means movably mounted to the mounting frame for movement between a stored position in the component mounting rack and an extended position;

at least one guide means, mounted to the mounting frame for movably mounting of the support means to the mounting frame; and at least one object retention means mounted on the support means for holding a musical instrument when the support means is in the extended position.

2. The apparatus of claim 1, wherein the mounting frame further comprises:

a first member having a front end, a rear end and an interior face, a second member having a front end, a rear end and an interior face, and a rear member having a first and second end, the rear end of the first member mounted to the second end of the rear member and the first end of the rear member mounted to the rear end of the second member, forming three sides of a rectangle, the interior face of the first member facing the interior face of the second member, the apparatus further comprising;

a first mounting bracket affixed to the front end of the first member, and a second mounting bracket affixed to the front end of the second member, each mounting bracket defining a plurality of apertures for receiving mounting bolts therethrough for attaching the mounting frame to the component mounting rack.

3. The apparatus of claim 1, wherein each support means comprises:

a support arm, having a first end and a second end;

a support shaft, having a first end and a second end, the first end mounted to the first end of the support arm, the support shaft permitting both lateral and pivotal movement of the arm; and a limit pin, mounted to the support shaft between the first and second ends of the support shaft, for engaging the guide means.

4. The apparatus for supporting musical instruments described in claim 3 wherein the guide means comprises at least one guide sleeve mounted to the mounting frame, each guide sleeve having:

a first end and a second end, and the guide sleeve having a guide channel, extending inward from the first end of the guide sleeve, for receiving the limit pin from the support shaft and allowing translational movement, but not rotational movement of the support shaft, until the limit pin has traveled past the first end of the guide sleeve;

a spring mounted around the support shaft, between the second end of the guide sleeve and the second end of the support shaft, for urging the support shaft toward the stored position; and the first end of the guide sleeve defining a plurality of recesses for receiving the limit pin and providing different angular orientations at which the rotational movement of the support shaft and support arm may be secured.

5. An object retention means for use on an apparatus for supporting an object such as a musical instrument, comprising:

an upper jaw, having a first aperture therethrough;

a lower jaw having at least one second aperture therethrough;

a shaft, having a first end and a second end, the first end slidingly passing through the first aperture in the upper jaw and the second end affixed to the lower jaw;

at least one grooved shaft, each grooved shaft having a first end and a second end, the first end being fixedly mounted to the upper jaw, and the second end passing through one of the second apertures in the lower jaw, the grooved shaft having a spirally oriented surface groove thereon;

at least one instrument restraint, each instrument restraint being arcular and having a first end and a second end, the first end having an aperture therethrough for receiving the grooved shaft, the instrument restraint further having a pin extending radially into the aperture for engaging the surface groove;

a spring, mounted on each grooved shaft between the upper jaw and the instrument restraint; whereby the upper jaw is urged away from the lower jaw, the upper jaw moving toward the lower jaw in response to the weight of the instrument on the upper jaw, causing the grooved shaft to descend though the second aperture in the lower jaw, urging the pin to move within the surface groove, causing the instrument restraint to rotate to enclose the instrument.

6. The object retention means described in claim 5, further comprising:

a base;

a side member, affixed in a generally perpendicular relationship to the lower jaw;

a mounting pin, affixed in a generally perpendicular relationship to the side member, and rotationally mounted to the base; and the lower jaw being heavier than the upper jaw and causing the lower jaw to be directly below the upper jaw regardless of angular orientation of the base.

7. The apparatus for supporting an object such as a musical instrument described in claim 1, wherein the object retention means are rotationally mounted to the support means, and each object retention means comprising:

an upper jaw, having a first aperture therethrough;

a lower jaw having at least one second aperture therethrough;

a shaft, having a first end and a second end, the first end slidingly passing through the first aperture in the upper jaw and the second end affixed to the lower jaw;

at least one grooved shaft, each grooved shaft having a first end and a second end, the first end being fixedly mounted to the upper jaw, and the second end passing through one of the second apertures in the lower jaw, the grooved shaft having a spirally oriented surface groove thereon;

at least one instrument restraint, each instrument restraint being arcular and having a first end and a second end, the first end having an aperture therethrough for receiving the grooved shaft, the instrument restraint further having a pin extending radially into the aperture for engaging the surface groove;

a spring, mounted on each grooved shaft between the upper jaw and the instrument restraint; whereby the upper jaw is urged away from the lower jaw, the upper jaw moving toward the lower jaw in response to the weight of the instrument on the upper jaw, causing the grooved shaft to descend though the second aperture in the lower jaw, urging the pin to move within the surface groove, causing the instrument restraint to rotate to enclose the instrument.

8. The apparatus for supporting an object such as a musical instrument described in claim 7, wherein the object retention means are rotationally mounted to the support means, the apparatus further comprising:

a side member, affixed in a generally perpendicular relationship to the lower jaw;

a mounting pin, affixed in a generally perpendicular relationship to the side member, and rotationally mounted to the support means; and the lower jaw being heavier than the upper jaw and causing the lower jaw to be directly below the upper jaw regardless of angular orientation of the base.

9. The apparatus of claim 1, wherein the object retention means comprises:

receiving means for receiving a part of a musical instrument instrument restraint means, movably connected to the receiving means;

means coupled to the recovery means for being coupled to the recovery means for being responsive to the weight of the musical instrument, for moving the instrument restraint means to enclose a part of the instrument; and coupling means for coupling the receiving means to the support means.

10. The apparatus of claim 9, wherein the coupling means is pivotally coupled to the support means for enabling the receiving means to pivot relative to the support means.

11. An object retention means for use on an apparatus for supporting an object such as a musical instrument, comprising:

receiving means for receiving a part of a musical instrument;

instrument restraint means, movably connected to the receiving means;

means coupled to the instrument restraint means being responsive to the weight of the musical instrument, for moving the instrument restraint means to enclose a part of the instrument; and coupling means for coupling the receiving means to the apparatus.

12. The apparatus of claim 11, wherein the coupling means is pivotally coupled to the apparatus for enabling the receiving means to pivot relative to the apparatus.

* * * * *